US009863168B2

(12) United States Patent
Woo

(10) Patent No.: US 9,863,168 B2
(45) Date of Patent: Jan. 9, 2018

(54) LOCKING UNIT AND G-SENSOR ASSEMBLY FOR VEHICLE TRAY USING THE SAME

(71) Applicants: Hyundai Motor Company, Seoul (KR); Kia Motors Corp., Seoul (KR)

(72) Inventor: Jung Hoon Woo, Hwaseong-Si (KR)

(73) Assignees: Hyundai Motor Company, Seoul (KR); Kia Motors Corp., Seoul (KR)

( * ) Notice: Subject to any disclaimer, the term of this patent is extended or adjusted under 35 U.S.C. 154(b) by 457 days.

(21) Appl. No.: 14/525,163

(22) Filed: Oct. 27, 2014

(65) Prior Publication Data

US 2015/0354251 A1 Dec. 10, 2015

(30) Foreign Application Priority Data

Jun. 5, 2014 (KR) ..... 10-2014-0068248

(51) Int. Cl.

| | |
|---|---|
| ***E05C 19/16*** | (2006.01) |
| ***E05B 77/06*** | (2014.01) |
| ***E05B 47/00*** | (2006.01) |
| ***E05B 83/30*** | (2014.01) |
| *E05C 19/02* | (2006.01) |

(52) U.S. Cl.

CPC ..... *E05B 77/06* (2013.01); *E05B 47/0038* (2013.01); *E05B 83/30* (2013.01); *E05C 19/022* (2013.01); *Y10S 292/22* (2013.01); *Y10T 292/11* (2015.04)

(58) Field of Classification Search

CPC .. E05B 47/0038; E05B 77/06; E05B 15/0073; E05B 83/30; E05C 19/022; E05C 19/16; Y10T 292/11; Y10S 292/22; Y10S 292/04

USPC ..... 292/251.5, DIG. 22, DIG. 4

See application file for complete search history.

(56) References Cited

U.S. PATENT DOCUMENTS

| | | | | |
|---|---|---|---|---|
| 4,238,087 A * | 12/1980 | Makishima | B60R 22/40 242/384.2 |
| 6,443,382 B1 * | 9/2002 | Bae | B60R 22/405 242/382.6 |
| 7,375,928 B2 * | 5/2008 | Kim | G11B 5/54 360/256.3 |
| 2007/0194578 A1 * | 8/2007 | Boosey | E05B 15/101 292/251.5 |

(Continued)

FOREIGN PATENT DOCUMENTS

| | | | |
|---|---|---|---|
| GB | 1151203 A * | 5/1969 | E04B 47/0042 |
| JP | 2005-349936 A | 12/2005 | |

(Continued)

*Primary Examiner* — Kristina Fulton
*Assistant Examiner* — Christine M Mills
(74) *Attorney, Agent, or Firm* — Morgan, Lewis & Bockius LLP

(57) ABSTRACT

A locking unit may include a case unit fixed to a first object; and a magnetic assembly for selectively engaging with a second object which is disposed outside the case unit, the magnetic assembly movably disposed in the case unit and including a plurality of magnets having a same polarity, wherein when a shock is generated, at least a portion of the magnetic assembly moves from inside the case unit to outside the case unit by a repulsive force generated between the plurality of magnets, thereby engaging with the second object and restricting rotation of the second object.

11 Claims, 4 Drawing Sheets

(56) References Cited

U.S. PATENT DOCUMENTS

| | | | | |
|---|---|---|---|---|
| 2014/0232122 | A1* | 8/2014 | Schnetter | E05B 77/06 292/336.3 |
| 2016/0060910 | A1* | 3/2016 | Ben Abdelaziz | E05B 81/70 292/251.5 |

FOREIGN PATENT DOCUMENTS

| | | | | |
|---|---|---|---|---|
| KR | 10-2001-0055160 | A | 7/2001 | |
| KR | 10-2002-0055335 | A | 7/2002 | |
| KR | 10-2006-0037874 | A | 5/2006 | |
| KR | 10-0645141 | B1 | 11/2006 | |
| KR | 10-2010-0069739 | A | 6/2010 | |
| KR | 10-1382821 | B1 | 4/2014 | |
| KR | 101382821 | B1 * | 4/2014 | B60R 7/06 |
| WO | WO 2013064234 | A1 * | 5/2013 | E04B 77/06 |

* cited by examiner

LOCKING UNIT AND G-SENSOR ASSEMBLY FOR VEHICLE TRAY USING THE SAME

CROSS REFERENCE TO RELATED APPLICATION

The present application claims priority of Korean Patent Application Number 10-2014-0068248 filed on Jun. 5, 2014, the entire contents of which application are incorporated herein for all purposes by this reference.

BACKGROUND OF INVENTION

Field of Invention

The present invention relates, in general, to a locking unit and a G-sensor assembly for a vehicle tray using the locking unit, and, more particularly, to a locking unit using a repulsive force between magnets having the same polarity, and a G-sensor assembly for a vehicle tray using the locking unit.

Description of Related Art

A G-sensor is a device for preventing a push type tray from opening due to the inertia load resulting from the impact in front, rear, vertical, and side collisions of vehicles. In the related art, G-sensors prevent push type trays from opening by locking a heart cam structure of the trays by applying a force opposite to the force that is generated in a car collision, using a weight. However, the weights of the G-sensors have a complicated structure and accordingly occupy large spaces, so the tray spaces are reduced and the mechanism for the operation thereof is complicated.

Various technologies regarding a G-sensor in the related art are described hereafter.

A "Locking device of tray in car" has been proposed in Korean conventional art. The device is for preventing a push type tray on a vehicle from opening due to inertia and keeping passengers safe. The locking device for an automotive tray includes a tray cover that opens the front of the tray and has a hook at a first end, a latch member that is locked by a first insertion of the hook of the tray and is unlocked by additional insertion of the hook, and a locking member that is locked and fixed to a side of the hook, only when inertia is generated opposite to the direction in which the hook is inserted into the latch member, in order to prevent the hook inserted and locked in the latch member from separating from the latch member due to an external shock.

A "Container apparatus" has also been proposed in Korean conventional art. The apparatus is for preventing a door from randomly opening due to malfunction caused by an external impact during a car collision, by holding a locking part with a retainer, when an external impact is applied by a car collision, and accordingly, for preventing passengers from being injured by the door unexpectedly projecting outward due to malfunction, when an external shock is applied in a car collision.

The container apparatus includes a housing with an open side, a door rotatably combined with the housing and opening/closing the open side, a locking part disposed on the door and operating in conjunction with the door, and a retainer disposed on the housing and holding the locking part by turning to a second position from a first position, when an external shock is applied.

Further, there are an "Apparatus for locking a console of an automobile" disclosed in Korean conventional art and a "Hinge structure of a console" disclosed in Japanese conventional art. However, in those documents, only the concept of using a magnet has been described. The notion of locking a heart cam to a G-sensor on a push type tray for a vehicle, using magnetism, when an external shock is applied has not been described.

The inventor(s) has recognized those problems in the related art and has thus developed a G-sensor structure having simple structure and operation mechanism and excellent performance.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Accordingly, the present invention has been made keeping in mind the above problems occurring in the related art and/or other problems, and the present invention is intended to provide a locking unit having simple structure and operation mechanism and excellent performance, and a G-sensor assembly for a vehicle tray using the locking unit.

According to various aspects of the present invention, there is provided a locking unit that includes: a case unit fixed to a first object; and a magnetic assembly for selectively engaging with a second object which is disposed outside the case unit, the magnetic assembly movably disposed in the case unit, wherein when a shock is generated, the magnetic assembly moves from inside the case unit to outside the case unit by a repulsive force generated between magnets having a same polarity, thereby engaging with the second object and restricting rotation of the second object.

The magnetic assembly may include: a first disc elastically disposed inside the case unit and having magnetism; a second disc movably disposed inside the case unit and having the same polarity as the first disc so that the repulsive force is generated when the first disc approaches the second disc; and a slider attached to a side of the second disc and having an end for selectively engaging with or locking the second object.

The slider may have a body and fastening pins protruding in one direction from the body. The first disc may be formed in a substantially ring shape and has an outer circumference connected to an inner side of the case unit through springs, and the second disc and the body of the slider are formed in a substantially disc shape.

The case unit may include an outer case with an open side and an inner case that includes a cover covering the open side of the outer case and a guide ring protruding from a side of the cover to facilitate positioning of the second disc, wherein the guide ring divides the cover into an inner area and an outer area, and through-holes are formed in the inner area of the cover.

The first disc may be connected with the inner side of the outer case through the springs, a body of the second disc may be fastened to the guide ring, and the springs may be circumferentially arranged. An inner diameter of the first disc may be equal to or larger than an inner diameter of the guide ring.

According to various other aspects of the present invention, there is provided a G-sensor assembly for a vehicle tray, which includes: a housing with one side open; a cover opening/closing the housing; a heart cam disposed on a side of the cover; a rotor rotatably disposed on a side of the housing and selectively locked to the heart cam; and a locking unit including a case unit fixed to a bracket on the housing, and a magnetic assembly for selectively engaging with the rotor outside the case unit, the magnetic assembly movably disposed in the case unit, wherein when a shock is generated, the magnetic assembly moves from inside the case unit to outside the case unit by a repulsive force generated between magnets having a same polarity, thereby engaging with the rotor and restricting rotation of the rotor.

The magnetic assembly may include: a first disc elastically disposed inside the case unit and having magnetism; a second disc movably disposed inside the case unit and having the same polarity as the first disc so that the repulsive force is generated when the first disc approaches the second disc; and a slider attached to a side of the second disc and having an end for selectively engaging with the rotor, thereby restricting the rotation of the rotor and locking the rotor to the heart cam.

The slider may have a body and fastening pins protruding in one direction from the body. The first disc may be formed in a substantially ring shape and has the outer circumference connected to an inner side of the case unit through springs, and the second disc and the body of the slider are formed in a substantially disc shape.

The case unit may include an outer case with an open side and an inner case that includes a cover covering the open side of the outer case and a guide ring protruding from a side of the cover of the inner case to facilitate positioning of the second disc, wherein the guide ring divides the cover of the inner case into an inner area and an outer area, and through-holes are formed in the inner area of the cover of the inner case.

The first disc may be connected with an inner side of the outer case through the springs, a body of the second disc may be fastened to the guide ring, and the springs may be circumferentially arranged. An inner diameter of the first disc may be equal to or larger than an inner diameter of the guide ring.

The present invention provides various effects, as follows, based on the configuration described above.

First, it is possible to prevent a tray from instantaneously opening due to an inertia load. Second, it is possible to prevent a tray from opening, with mechanical friction minimized. Third, it is possible to achieve simple structure and operation mechanism and excellent performance. Fourth, it is possible to minimize an installation space.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinbelow, a locking unit according to exemplary embodiments of the present invention and a G-sensor assembly for a vehicle tray using the locking unit will be described hereinafter with reference to the accompanying drawings.

Figure 1:
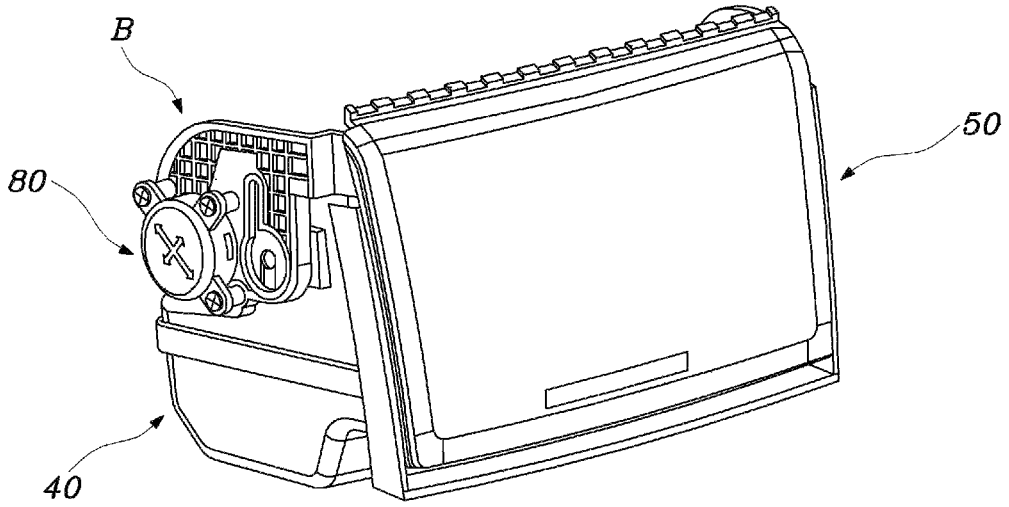
FIG. 1 is a perspective view showing an exemplary G-sensor assembly using an exemplary locking unit of the present invention.

As shown in FIG. 1, a G-sensor assembly for a vehicle tray using a locking unit of the present invention includes a housing 40, a cover 50, a heart cam 60, a rotor 70, and a locking unit 80.

Spaces for receiving things are provided at various positions in vehicles, the housing 40 with one side open is disposed in each of the spaces, and the cover 50 is rotatably attached to the side of the housings 40, so a user opens/closes the housing 40 by pushing/pulling the cover 50.

Figure 2:
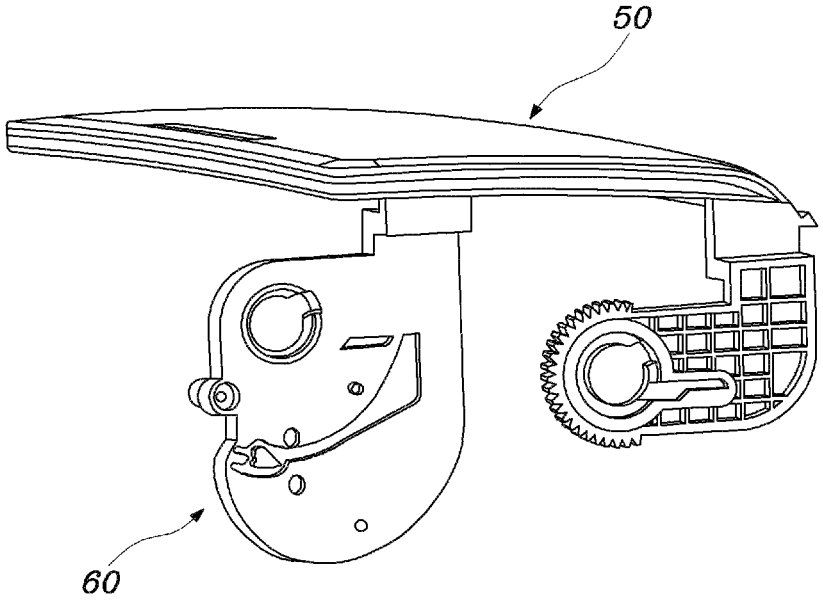
FIG. 2 is a view showing the structure of a cover and a heart cam in an exemplary G-sensor assembly of the present invention.
Figure 3:
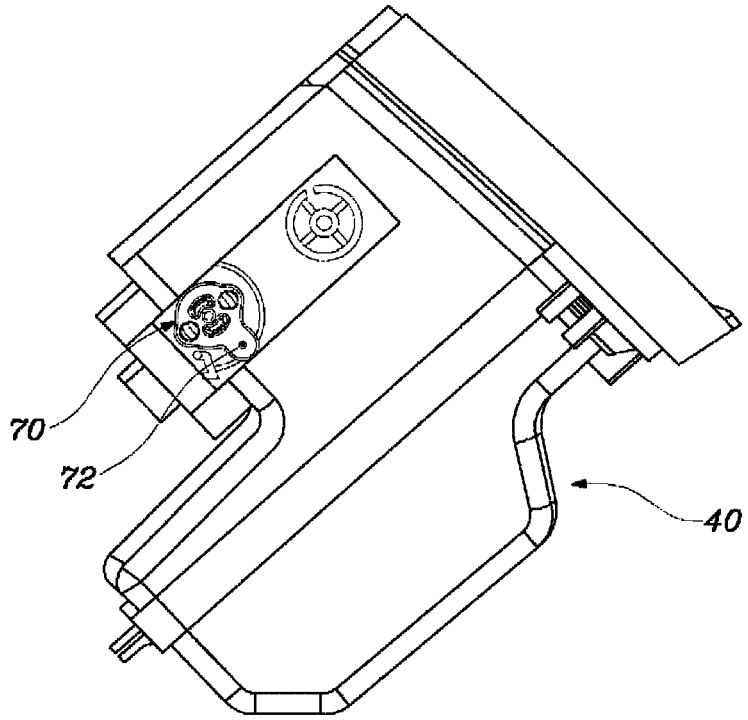
FIG. 3 is a view showing a rotor mounted on a housing in an exemplary G-sensor assembly of the present invention.

As shown in FIGS. 2 and 3, the heart cam 60 is mounted on one side of the cover 50 and the rotor 70 is rotatably mounted on one side of the housing 40, such that as a locking pin 72 formed on the rotor 70 is selectively locked to or unlocked from the heart cam 60, the cover 50 closes or opens the housing 40.

Figure 4:
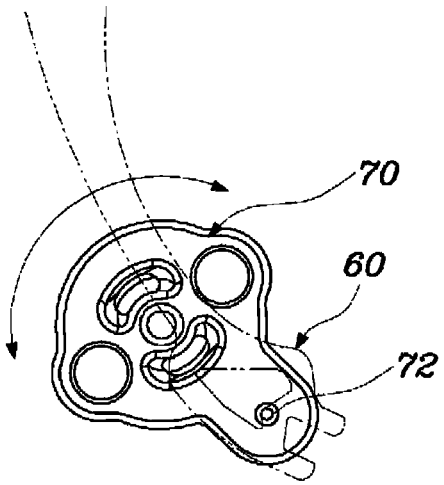
FIG. 4 is a view showing the state of the rotor and the heart cam when the cover closes the housing in an exemplary G-sensor assembly of the present invention.
Figure 5:
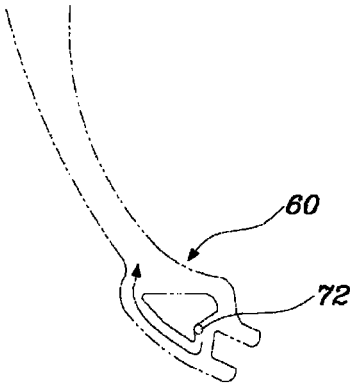
FIG. 5 is a view showing the state of the rotor and the heart cam when the cover opens the housing in an exemplary G-sensor assembly of the present invention.

FIGS. 4 and 5 show the states when the cover 50 closes and opens the housing 40, respectively. As shown in FIG. 4, when the cover 50 closes the housing 40, the locking pin 72 of the rotor 70 is locked to the heart cam 60, so rotation of the rotor 70 is restricted and the housing 40 keeps closed. As shown in FIG. 5, as a user pushes the cover 50, the locking pin 72 and the heart cam 60 are unlocked from each other, the locking pin 72 moves, and the rotor 70 rotates accordingly, such that the cover 50 opens the housing 40.

Figure 6:
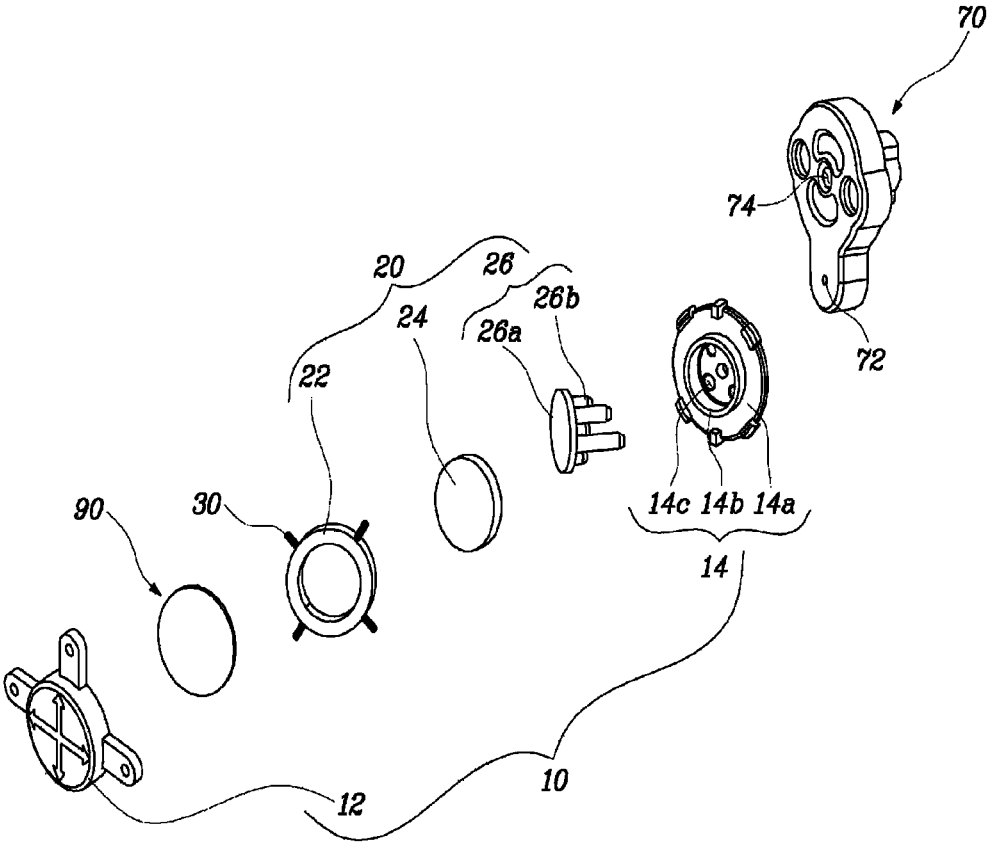
FIG. 6 is an exploded perspective view of an exemplary locking unit in accord with the present invention.

As shown in FIG. 6, the locking unit of the present invention includes a case unit 10 and a magnetic assembly 20. The case unit 10, which is for protecting the magnetic assembly 20, is fixed to a bracket B on a side of the housing 40.

The magnetic assembly 20 is movably disposed in the case unit 10. The magnetic assembly 20 is at a predetermined position, when an external shock is not transmitted, but it is moved and engaged to the rotor 70 and restricts rotation of the rotor 70, when an external shock is transmitted.

The force enabling the magnetic assembly 20 to be moved is the magnetism of the magnetic assembly 20, that is, a repulsive force. The magnetic assembly 20 has at least two magnets, so the magnetic assembly 20 itself can move, using the repulsive force between the two magnets having the same polarity.

The two magnets are under an environment in which they do not generate a repulsive force in a normal state, but when an external shock is applied, any one or both of the two magnets move and generate a repulsive force, such that the magnetic assembly 20 moves.

The locking pin 72 of the rotor 70 is locked to the heart cam 60, when the cover 50 is closed, but when an external shock is transmitted, the locking pin 72 is unlocked. When a shock is applied, the magnetic assembly 20 moves in this way and engages with the rotor 70, thereby restricting rotation of the rotor 70, and accordingly, the cover 50 can keep closed, even if an external shock is applied.

The two magnets of the magnetic assembly 20 may be implemented by a first disc 22 and a second disc 24, which have a same polarity, and a slider 26 may be combined with the second disc 24. Further, a pad 90 may be disposed between the case unit 10 and the first disc 22, for smoother operation of the first disc 22 in the case unit 10. The first disc 22 may be formed in or substantially in a ring shape and the second disc 24 may be formed in or substantially in a circle.

The slider 26 has a body 26*a* and fastening pins 26*b* and the case unit 10 may include an outer case 12 and an inner case 14. The ring-shaped first disc 22 has magnetism and is connected to the inner side of the outer case 12 through a spring 30. The second disc 24 is formed in the shape of a circular or substantially circular plate and movably fastened to the inner case 14, having the same polarity as the first disc 22.

The spring 30 returns the first disc 22 moved by an external shock to the initial position. A plurality of springs 30 may be circumferentially arranged on the first disc 22 to minimize a change in position of the first disc 22 by an external shock.

That is, when only one spring 30 for absorbing an external shock is provided, the spring 30 may deform and a change in position of the first disc 22 increases, and accordingly, when the change in position increases, it may exceed the elastic limit of the spring 30. It is possible to solve this problem by arranging a plurality of springs 30 circumferentially on the first disc 22.

The inner case 14 has a cover 14*a* covering an open side of the outer case 12, a guide ring 14*b* protruding from a side of the cover 14*a* so that the second disc 24 can be inserted and moved, and through-holes 14*c* formed in an inner area of the cover 14*a* divided into the inner area and an outer area by the guide ring 14*b*. The slider 26 has the body 26*a* and the fastening pins 26*b* protruding in one direction from the body 26*a*.

The second disc 24 is movably inserted inside the guide ring 14*b* and moves inside the guide ring 14*b*, with the body 26*a* of the slider 26 connected to a side of the second disc 24.

The fastening pins 26*b* protrude from the body 26*a* to pass through the through-holes 14*c* of the inner case 14 and in some embodiments, the numbers of the fastening pins 26 and the through-holes 14*c* are the same.

The inner case 14 can be divided by the guide ring 14*b* into the inner area that is the inside of the guide ring 14*b* and the outer area that is the outside of the guide ring 14*b*, and the through-holes 14*c* need to be formed in the inner area so that the fastening pins 26*b* protruding from the disc-shaped body 26*a* movably inserted inside the guide ring 14*b* can pass through them.

Anti-rotation holes 74 are formed in the rotor 70 so that the fastening pins 26*b* passing through the through-holes 14*c* can be inserted therein.

The inner diameter of the first disc 22 may be the same as or larger than the inner diameter of the guide ring 14*b*.

There is a need of an environment without a repulsive force between the first disc 22 and the second disc in a normal state without an external force and the environment can be achieved in various ways, for example, adjusting the gap between the first disc 22 and the second disc 24 or changing the structures of the first disc 22 and the second disc 24.

For example, as described above, when the inner diameter of the first disc 22 is made the same as or larger than the inner diameter or the guide ring 14*b* and the second disc 24 is positioned to correspond to the inner diameter of the first disc 22, a magnetic force does not reach to between the first disc 22 and the second disc 24.

In this state, when an external shock is applied, the first disc 22 moves and the surface of the first disc 22 and the surface of the second disc 24 face each other, in which a repulsive force is generated and the second disc 24 can move inside the guide ring 14*b*.

Hereinbelow, the operation process of the present invention will be briefly described with reference to FIGS. 6, 7, and 8.

Figure 7:
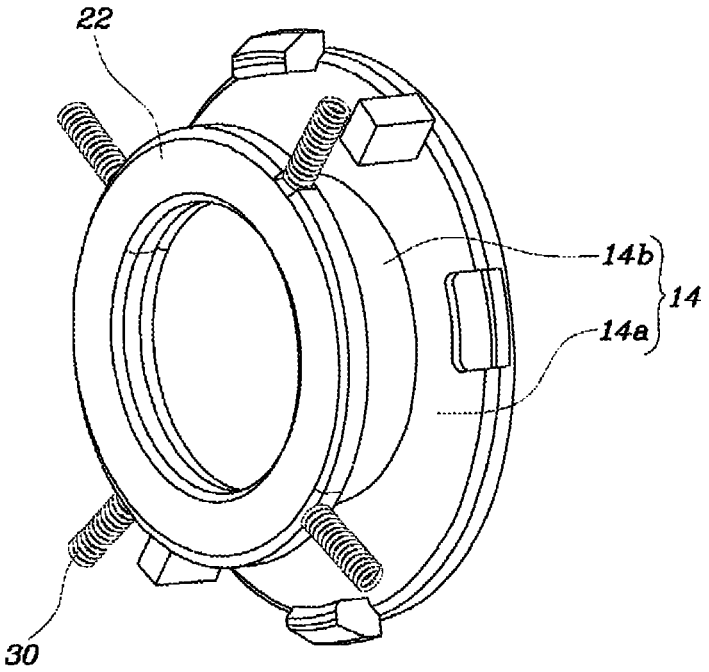
FIG. 7 is a view showing the state before an exemplary locking unit of the present invention operates.

As shown in FIGS. 6 and 7, the second disc 24 is positioned to correspond to the inner diameter of the first disc 22 so that a repulsive force is not generated between the first disc 22 and the second disc 24 having the same polarity in a normal state.

Since the inner diameter of the first disc 22 is the same as or larger than the inner diameter of the guide ring 14*b*, it is larger than the diameter of the second disc 24 inserted inside the guide ring 14*b*, and therefore a repulsive force is not generated between the first disc 22 and the second disc 24.

Figure 8:
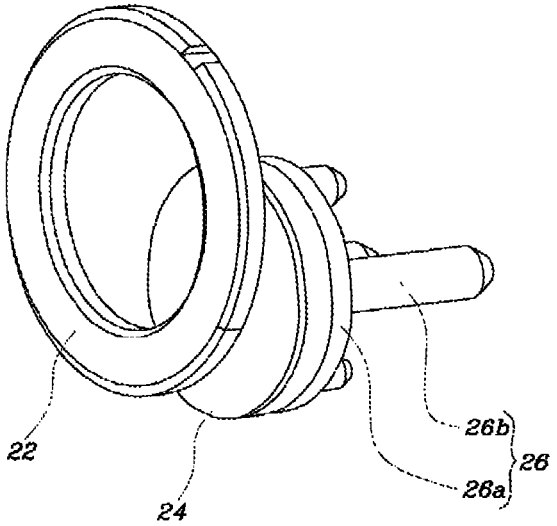
FIG. 8 is a view showing the operation process of an exemplary locking unit of the present invention.

As shown in FIGS. 6 and 8, when an external shock is transmitted, the first disc 22 moves in one direction. That is, when an inertia load is generated in one direction, the surface of the first disc 22 and the surface of the second disc 24 face each other and a repulsive force is generated between the first disc 22 and the second disc 24 which have the same polarity.

When a repulsive force is generated, the second disc 24 moves inside the guide ring 14*b*, the slider 26 combined with the second disc 24 moves accordingly, and the fastening pins 26*b* are inserted into the anti-rotation holes 74 of the rotor 70 through the through-holes 14*c*, such that rotation of the rotor 70 is restricted.

For convenience in explanation and accurate definition in the appended claims, the terms "upper" or "lower", "inside" or "outside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A locking unit comprising:

a case unit fixed to a first object; and a magnetic assembly for selectively engaging with a second object which is disposed outside the case unit, the magnetic assembly movably disposed in the case unit and including a plurality of magnets having a same polarity, wherein when a shock is generated, at least a portion of the magnetic assembly moves from inside the case unit to outside the case unit by a repulsive force generated between the plurality of magnets, thereby engaging with the second object and restricting rotation of the second object, wherein the magnetic assembly includes:

a first disc elastically disposed inside the case unit as one of the plurality of magnets and having magnetism; and a second disc movably disposed inside the case unit as another one of the plurality of magnets and having the same polarity as the first disc so that the repulsive force is generated when the first disc approaches the second disc; and a slider attached to a side of the second disc and having an end for selectively engaging with or locking the second object, and wherein the case unit includes:

an outer case with an open side; and an inner case that includes a cover covering the open side of the outer case and a guide ring protruding from a side of the cover to facilitate positioning of the second disc, wherein the slider includes a body and fastening pins protruding in one direction from the body, wherein the guide ring divides the cover into an inner area and an outer area, and through-holes are formed in the inner area of the cover, the fastening pins of the slider passing through the through-holes of the cover.

2. The locking unit of claim 1, wherein the first disc is formed in a substantially ring shape and has an outer circumference connected to an inner side of the case unit through springs, and the second disc and the body of the slider are formed in a substantially disc shape.

3. The locking unit of claim 2, wherein the first disc is connected with an inner side of the outer case through the springs, a body of the second disc is fastened to the guide ring, and the springs are circumferentially arranged.

4. The locking unit of claim 1, wherein an inner diameter of the first disc is equal to or larger than an inner diameter of the guide ring.

5. A G-sensor assembly for a vehicle tray, comprising:

a housing with one side open;

a cover opening and closing the housing;

a heart cam disposed on a side of the cover;

a rotor rotatably disposed on a side of the housing and selectively locked to the heart cam; and a locking unit including a case unit fixed to a bracket on the housing, and a magnetic assembly for selectively engaging with the rotor outside the case unit, the magnetic assembly movably disposed in the case unit and including a plurality of magnets having a same polarity, wherein when a shock is generated, at least a portion of the magnetic assembly moves from inside the case unit to outside the case unit by a repulsive force generated between the plurality of magnets, thereby engaging with the rotor and restricting rotation of the rotor.

6. The G-sensor assembly of claim 5, wherein the magnetic assembly includes:

a first disc elastically disposed inside the case unit as one of the plurality of magnets and having magnetism;

a second disc movably disposed inside the case unit as another one of the plurality of magnets and having the same polarity as the first disc so that the repulsive force is generated when the first disc approaches the second disc; and a slider attached to a side of the second disc and having an end for selectively engaging with the rotor, thereby restricting the rotation of the rotor and locking the rotor to the heart cam.

7. The G-sensor assembly of claim 6, wherein the slider includes a body and fastening pins protruding in one direction from the body.

8. The G-sensor of claim 7, wherein the first disc is formed in a substantially ring shape and has an outer circumference connected to an inner side of the case unit through springs, and the second disc and the body of the slider are formed in a substantially disc shape.

9. The G-sensor assembly of claim 8, wherein the case unit includes:

an outer case with an open side; and an inner case that includes a cover covering the open side of the outer case and a guide ring protruding from a side of the cover of the inner case to facilitate positioning of the second disc, wherein the guide ring divides the cover of the inner case into an inner area and an outer area, and through-holes are formed in the inner area of the cover of the inner case.

10. The G-sensor assembly of claim 9, wherein the first disc is connected with an inner side of the outer case through the springs, a body of the second disc is fastened to the guide ring, and the springs are circumferentially arranged.

11. The G-sensor assembly of claim 9, wherein an inner diameter of the first disc is equal to or larger than an inner diameter of the guide ring.

* * * * *